US012599202B2

(12) United States Patent
Miyata

(10) Patent No.: US 12,599,202 B2
(45) Date of Patent: Apr. 14, 2026

(54) BAND AND TIMEPIECE

(71) Applicant: CASIO COMPUTER CO., LTD., Tokyo (JP)

(72) Inventor: Masaki Miyata, Musashino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 639 days.

(21) Appl. No.: 18/065,032

(22) Filed: Dec. 13, 2022

(65) Prior Publication Data

US 2023/0189942 A1 Jun. 22, 2023

(30) Foreign Application Priority Data

Dec. 16, 2021 (JP) ..... 2021-204410

(51) Int. Cl.
*A44C 5/14* (2006.01)

(52) U.S. Cl.
CPC ..... *A44C 5/14* (2013.01)

(58) Field of Classification Search
CPC ..... G04B 37/1486; G04B 37/18; G04B 37/1492; G04B 37/16; G04B 37/20; A44C 13/00; A44C 17/02; A44C 17/0208; A44C 25/00; A44C 17/0241; A44C 17/025; A44C 25/007; A44C 5/025; A44C 5/14; A44C 5/0007; A44C 5/00
USPC ..... 63/21, 23, 29.1, 33, 40; 368/282; D11/3, 11, 93, 94, 32
See application file for complete search history.

(56) References Cited

U.S. PATENT DOCUMENTS 4,218,991 A * 8/1980 Cole ..... A01K 27/007 119/858

FOREIGN PATENT DOCUMENTS

| | | | |
|---|---|---|---|
| CN | 214432319 | U | 10/2021 |
| JP | S57169115 | U | 10/1982 |
| JP | S6056314 | U | 4/1985 |
| JP | H0311815 | U | 2/1991 |
| JP | H07322904 | A | 12/1995 |
| JP | 3063106 | U | 10/1999 |

OTHER PUBLICATIONS

Notice of Reasons for Refusal dated May 27, 2025 received in Japanese Patent Application No. 2021-204410.

* cited by examiner

*Primary Examiner* — Jack W Lavinder
(74) *Attorney, Agent, or Firm* — Scully, Scott, Murphy & Presser, P.C.

(57) ABSTRACT

A band including a band main body in which a catching portion with one end open is provided extending in a longitudinal direction, and a decorative member having a decorative main body which is arranged on at least an outer surface of the band main body and an engaging portion which is provided on the decorative main body and slidably caught in the catching portion.

20 Claims, 20 Drawing Sheets

BAND AND TIMEPIECE

CROSS-REFERENCE TO RELATED APPLICATION

This application is based upon and claims the benefit of priority from the prior Japanese Patent Application No. 2021-204410, filed Dec. 16, 2021, the entire contents of which are incorporated herein by reference.

BACKGROUND OF THE INVENTION

1. Field of the Invention

The present invention relates to a band that is used for wristwatches, briefcases, handbags, clothes, or the like, and a timepiece having the band.

2. Description of the Related Art

For example, a watch band where an interchangeable decorative member has been attached to its band main body is known, as described in Japanese Utility Model Application Laid-Open (Kokai) Publication No. S57-169115.

The decorative member attached to this type of band includes a decorative main body which is arranged on the outer surface of the band main body in a transverse direction perpendicular to a longitudinal direction of the band main body, and an attachment plate which is arranged on the inner surface of the band main body and attached to both ends of the decorative main body. On the ends of the decorative main body, leg sections are provided which are arranged to the sides of the band main body toward the inner surface side of the band main body, and the ends of the attachment plate are attached to these leg sections on the ends of the decorative main body by screws.

When the decorative member is to be attached to the band main body, the leg sections on the ends of the decorative main body are inserted from the outer surface side of the band main body into cutout recess sections formed in the sides of the band main body in the transverse direction, and thereby protrude on the inner surface side of the band main body. In this state, the ends of the attachment plate of the decorative member are arranged corresponding to the undersurfaces of the leg sections of the decorative main body, and attached thereto from below by the screws. As a result, the decorative member is attached to the band main body.

SUMMARY OF THE INVENTION

In accordance with one aspect of the present invention, there is provided a band comprising: a band main body in which a catching portion with one end open is provided extending in a longitudinal direction; and a decorative member having a decorative main body which is arranged on at least an outer surface of the band main body and an engaging portion which is provided on the decorative main body and slidably caught in the catching portion.

In accordance with another aspect of the present invention, there is provided a timepiece comprising the above-described band.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

A first embodiment where the present invention has been applied in a wristwatch will hereinafter be described with reference to FIG. 1 to FIG. 5.

Figure 1:
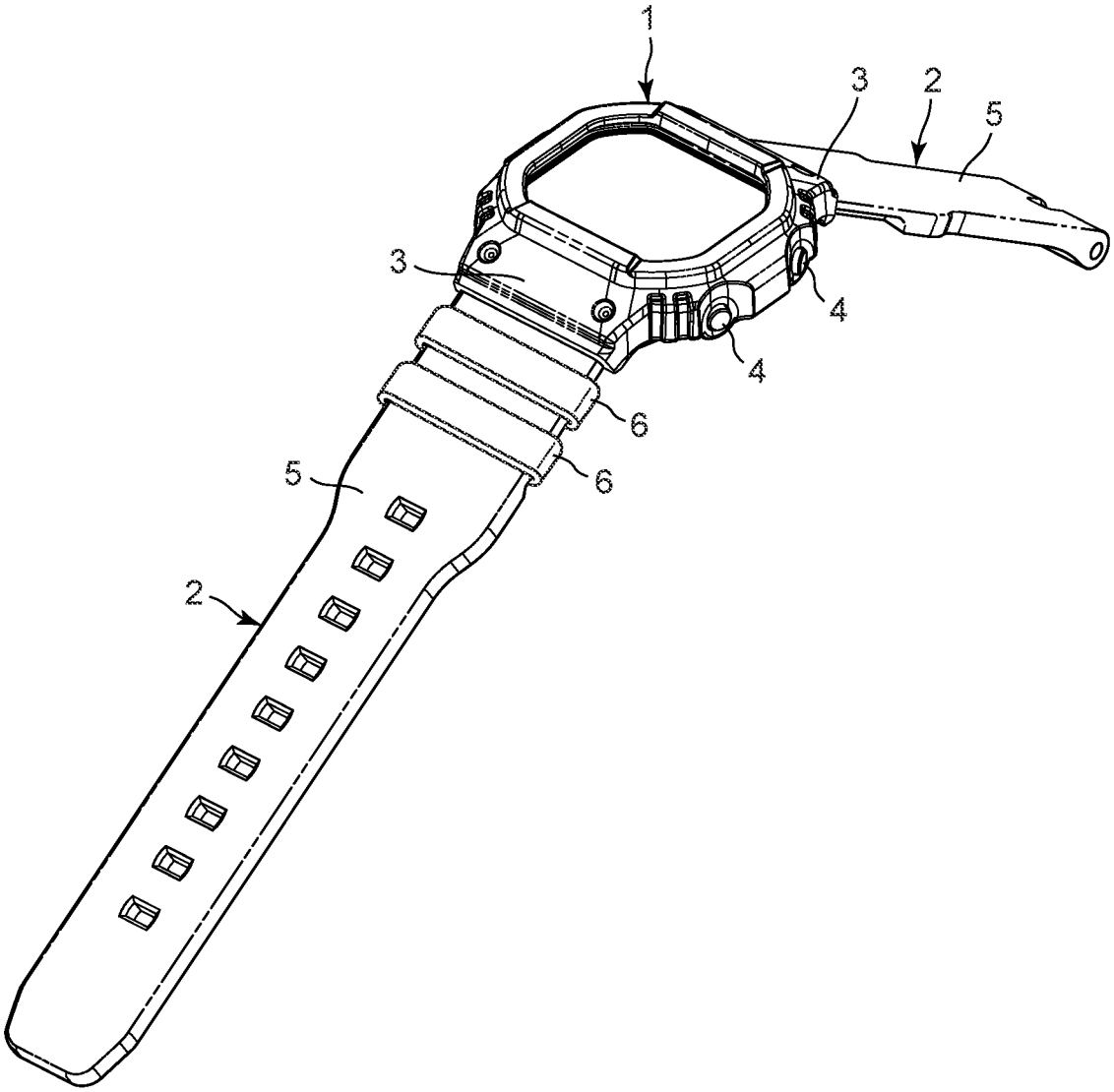
FIG. 1 is a perspective view of a first embodiment in which the present invention has been applied in a wristwatch.

This wristwatch includes a wristwatch case 1, as shown in FIG. 1. On the twelve o'clock side and six o'clock side of the wristwatch case 1, band attachment sections 3 to which watch bands 2 are attached are provided. Also, on the two o'clock side, four o'clock side, eight o'clock side, and ten o'clock side of the wristwatch case 1, push button switches 4 are provided.

In a conventional watch band, an attachment plate for a decorative member is attached from the inner surface side of a band main body to leg sections of the decorative main body by screws. Accordingly, this type of band has a problem in that the decorative member is difficult to be attached.

The present invention is to improve this problem. In the case of the present invention, a decorative member can be easily and favorably attached to each watch band 2.

Figure 2:
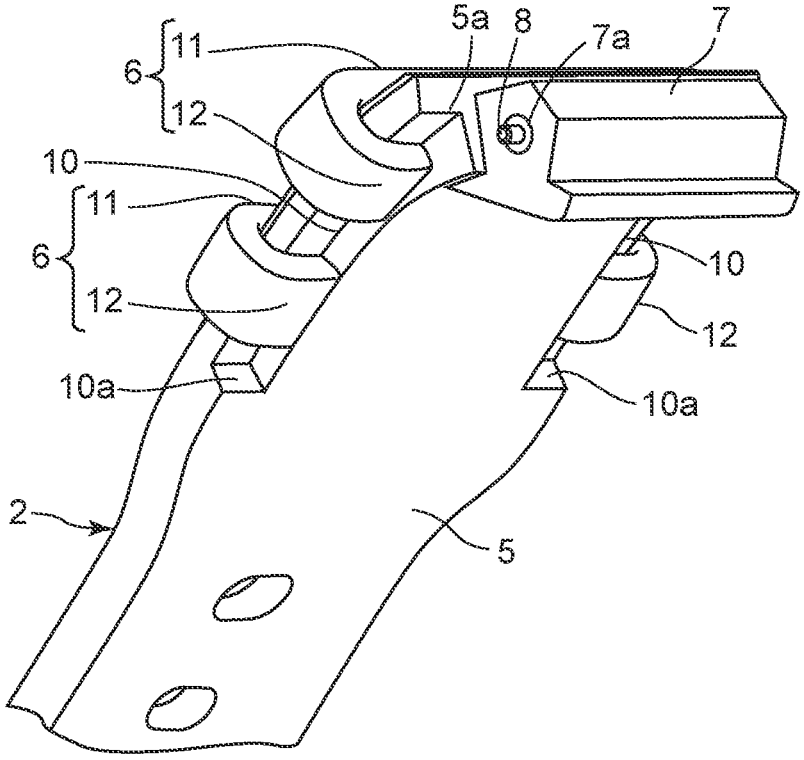
FIG. 2 is an enlarged perspective view showing a main portion of a watch band of the wristwatch shown in FIG. 1.
Figure 3:
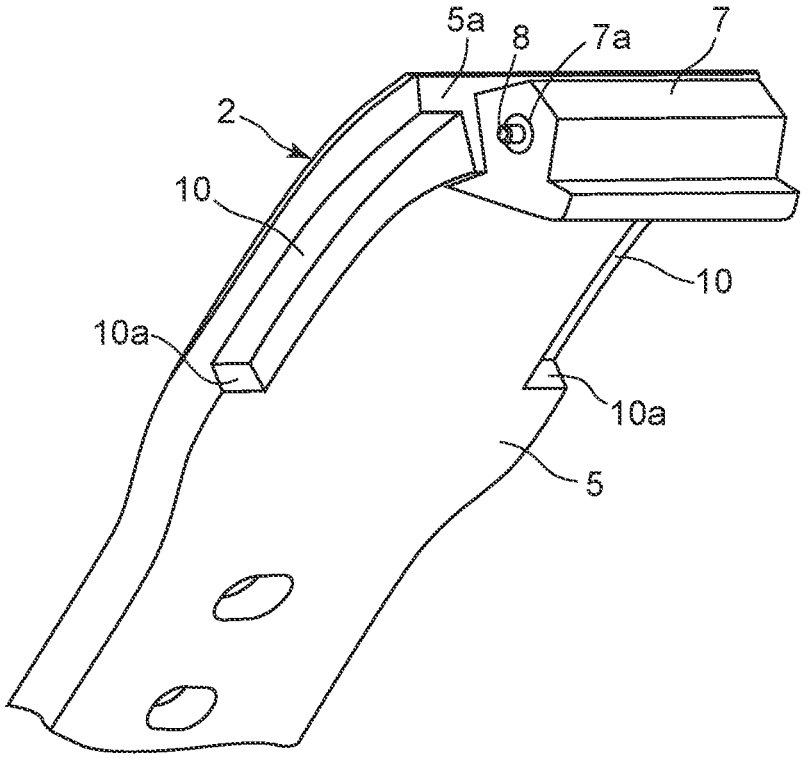
FIG. 3 is an enlarged perspective view showing the main portion of the watch band from which a decorative member shown in FIG. 2 has been detached.

Each watch band 2 includes a band main body 5, as shown in FIG. 1 to FIG. 3. This band main body 5 should preferably be formed of a synthetic resin having elasticity, such as urethane resin. However, it may be a metal body formed by band pieces being connected to one another. To an end portion 5*a* on the wristwatch case 1 side of the band main body 5 of one of the watch bands 2, a plurality of decorative members 6 is attached such that they are interchangeable to other decorative members. Also, on the very end of this end portion 5*a* of the band main body 5, a connection section 7 is provided.

The connection section 7 is structured such that the band main body 5 is attached to the corresponding band attachment section 3 of the wristwatch case 1 by a connection member 8, as shown in FIG. 2 and FIG. 3. More specifically, in the connection section 7, an attachment hole 7*a* into which the connection member 8 is inserted and attached is provided penetrating in a transverse direction of the band main body 5.

Figure 4:
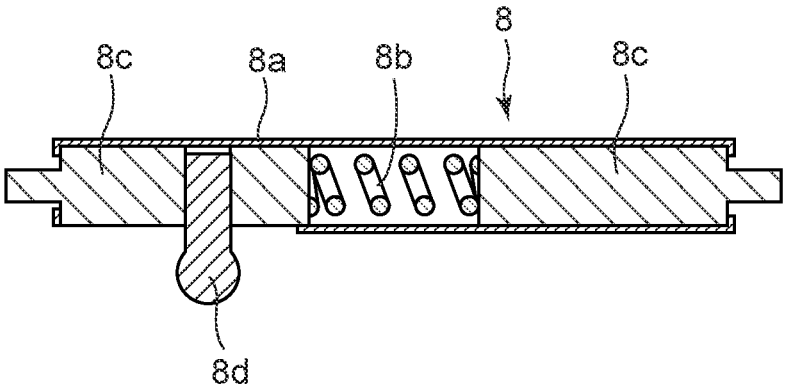
FIG. 4 is an enlarged cross-sectional view of a connection member attached to the watch band shown in FIG. 3.

The connection member 8 is a spring bar having a pipe section 8*a* which is inserted into the attachment hole 7*a* of the connection section 7, a spring member 8*b* which is arranged in the pipe section 8*a*, a pair of pin components 8*c* which is retractably arranged in the sides of the pipe section 8*a*, and a lever section 8*d* which is provided on one of the pair of pin components 8*c*, as shown in FIG. 4.

The spring member 8*b* is a coil spring and structured to force the pair of pin components 8*c* in directions in which the pin components 8*c* are pushed toward the outside of the pipe section 8*a*, as shown in FIG. 4. Each of these pin components 8*c* includes a large-diameter portion which is arranged in the pipe section 8*a* and a small-diameter portion which is pushed outside the pipe section 8*a*. The lever section 8*d* is structured to be attached to the large-diameter portion of one of the pin components 8*c* and used to slide this pin component 8*c* against the spring force of the spring member 8*b*.

Also, the connection member 8 is structured such that, when its pipe section 8*a* is inserted into the attachment hole 7*a* formed in the connection section 7 of the band main body 5, the small-diameter portions of the pair of pin components 8*c* are pushed and protrude outside through the sides of the pipe section 8*a* by the spring force of the spring member 8*b*, as shown in FIG. 2 to FIG. 4.

Moreover, the connection member 8 is structured such that, by the small-diameter portion of one of the pair of pin components 8*c* being slid against the spring force of the spring member 8*b* by the operation of the lever section 8*d* so as to be pushed into the pipe section 8*a*, the connection section 7 of the watch band 2 can be arranged in an attachment recess section (not shown) in the band attachment section 3 of the wristwatch case 1, as shown in FIG. 1 to FIG. 4.

That is, the connection member 8 is structured such that, when the connection section 7 of the band main body 5 is arranged in the attachment recess section (not shown) in the band attachment section 3 of the wristwatch case 1, the small-diameter portion of one pin component 8*c* which does not have the lever section 8*d* and has been pushed and positioned outside the pipe section 8*a* by the spring force of the spring member 8*b* is inserted into one of the connection holes formed in the sides of the inner surface of the attachment recess section in the band attachment section 3, as shown in FIG. 1 to FIG. 4.

Also, the connection member 8 is structured such that, when the connection section 7 of the band main body 5 is arranged in the attachment recess section (not shown) in the band attachment section 3 of the wristwatch case 1, the small-diameter portion of the other pin component 8*c* having the lever section 8*d* is pushed and positioned outside the pipe section 8*a* by the spring force of the spring member 8*b* and inserted into the other connection hole in the attachment recess section of the band attachment section 3, as shown in FIG. 1 to FIG. 4.

As a result, the connection member 8 is structured such that, by the small-diameter portions of the pair of pin components 8*c* being pushed outward by the spring force of the spring member 8*b* and inserted into the connection holes in the sides of the inner surface of the attachment recess section in the band attachment section 3, the connection section 7 of the band main body 5 is attached to the band attachment section 3 of the wristwatch case 1, as shown in FIG. 1 to FIG. 4.

On the end portion 5*a* side of the band main body 5 of the watch band 2 where the decorative members 6 are attached, catching recess sections 10 which are catching portions are formed along a longitudinal direction of the band main body 5, as shown in FIG. 2 and FIG. 3. More specifically, the catching recess sections 10 are formed along the longitudinal direction of the band main body 5, in the sides of the inner surface of the band main body 5 in the transverse direction. Each catching recess section 10 is a cutout section having a recess shape and open to the inner surface side and side surface side of the band main body 5. The length of each catching recess section 10 in the longitudinal direction of the band main body 5 is longer than its length in the transverse direction of the band main body 5.

Also, the catching recess sections 10 are formed in the outer sides of the band main body 5 in the transverse direction and located further outside than the sides of the connection section 7 of the band main body 5, as shown in FIG. 2 and FIG. 3. As a result, the catching recess sections 10 are open to an end surface of the end portion 5*a* of the band main body 5 in the longitudinal direction of the band main body 5. Also, on end portions of the catching recess sections 10 located opposite to the end portion 5*a* of the band main body 5, stopper sections 10*a* with which later-described engagement sections 12 of the decorative members 6 comes in contact are formed.

Figure 5:
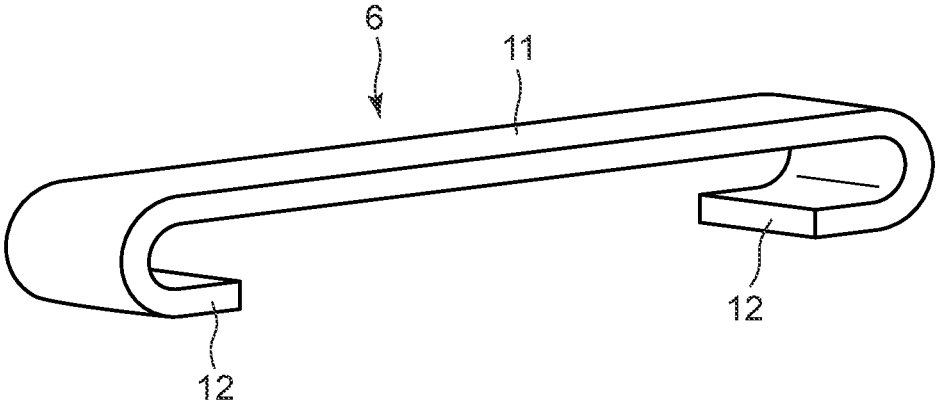
FIG. 5 is an enlarged perspective view of the decorative member for the watch band shown in FIG. 2.

The plurality of decorative members 6 is made of a metal such as stainless steel, titanium, and aluminum, or a hard synthetic resin such as ABS (Acrylonitrile Butadiene Styrene) resin, as shown in FIG. 2 and FIG. 5. Each decorative member 6, which is structured to be attached to the end portion 5*a* side of the band main body 5, includes a decorative main body 11 which is arranged on the outer surface of the band main body 5, and engaging sections 12 which are formed on the ends of the decorative main body 11 and slidably caught in the catching recess sections 10 of the band main body 5.

The decorative main body 11 is formed in an elongated band plate shape along the transverse direction of the band main body 5, as shown in FIG. 2 and FIG. 5. More specifically, the decorative main body 11 is formed such that its length (width) in the longitudinal direction of the band main body 5 is about one-half to one-third of its length in the transverse direction of the band main body 5. The engaging sections 12 formed on the ends of the decorative main body 11 extend along the side surfaces of the band main body 5 from the outer surface side of the band main body 5 and bent toward the insides of the catching recess sections 10 on the inner surface side.

That is, the engaging sections 12 are bent in a manner to be caught in the catching recess sections 10 and slidably pinch both sides of the band main body 5, as shown in FIG. 2 and FIG. 5. The vertical length (thickness) of a portion of each engaging section 12 which is arranged in the corresponding catching recess section 10 is equal to or slightly shorter than the vertical length of the catching recess section 10. As a result, the engaging sections 12 are structured not to project on the inner surface side of the band main body 5 when they are arranged in the catching recess sections 10.

Accordingly, each decorative member 6 is structured such that, from the end portion 5*a* side of the band main body 5, the decorative main body 11 is slid through the outer surface side of the connection section 7 provided on the end portion 5*a* of the band main body 5, and the engaging sections 12 formed on the ends of the decorative main body 11 are inserted into the catching recess sections 10 of the band main body 5, whereby the decorative main body 11 is arranged on the outer surface (upper surface) of the band main body 5, as shown in FIG. 2 and FIG. 5.

Also, the engaging sections 12 of each decorative member 6 are structured not to come in contact with the connection member 8 in the connection section 7, the sides of the band main body 5 in the transverse direction, and the inner and outer surfaces of the band main body 5 in the vertical direction (thickness direction) when these engaging sections 12 are inserted into the catching recess sections 10 of the band main body 5 from the end portion 5*a* side of the band main body 5. Each catching recess section 10 is structured such that its portion on the end portion 5*a* side of the band main body 5 is more widely open than its portion on the side opposite to the end portion 5*a* of the band main body 5, so that each decorative member 6 is easily inserted into the catching recess sections 10 of the band main body 5.

Also, each decorative member 6 is structured such that the engaging sections 12 caught in the catching recess sections 10 can be slid in the catching recess sections 10 in the longitudinal direction of the band main body 5 without protruding from the inside of the catching recess section 10 toward the inner surface side of the band main body 5, as shown in FIG. 2 and FIG. 5.

In the present embodiment, among the plurality of decorative members 6, the first decorative member 6 to be attached to the band main body 5 has a structure where it is positionally restricted by its engaging sections 12 coming in contact with the stopper sections 10*a* of the catching recess sections 10, as shown in FIG. 2. Note that the outer surface of each decorative member 6 may be colored, patterned, or carved.

Next, a procedure for switching the plurality of decorative members 6 attached to the corresponding watch band 2 of the wristwatch to other decorative members is described.

First, the watch band 2 is detached from the corresponding band attachment section 3 of the wristwatch case 1. Here, the lever section 8*d* of the connection member 8 inserted into the attachment hole 7*a* in the connection section 7 of the band main body 5 is operated, whereby the connection between the band main body 5 and the band attachment section 3 of the wristwatch case 1 by the connection member 8 is released.

More specifically, when the lever section 8*d* is operated against the spring force of the spring member 8*b* and the corresponding pin component 8*c* is slid thereby, the small-diameter portion of the pin component 8*c* is pulled out from the corresponding connection hole (not shown) of the band attachment section 3 of the wristwatch case 1, and pulled into the pipe section 8*a*, whereby the connection between the band main body 5 and the band attachment section 3 of the wristwatch case 1 by the connection member 8 is released, and the watch band 2 is detached from the band attachment section 3 of the wristwatch case 1.

In this state, each decorative member 6 is slid and removed from the watch band 2. More specifically, when this decorative member 6 is slid in the longitudinal direction of the watch band 2, the engaging sections 12 of the decorative member 6 caught in the catching recess sections 10 formed in the sides of the of band main body 5 in the transverse direction are slid along the catching recess sections 10.

In this embodiment, the catching recess sections 10 formed in the sides of the band main body 5 in the transverse direction are located further outside than the sides of the connection section 7 provided on the end portion 5*a* of the band main body 5. Accordingly, when slid toward the connection section 7 side of the band main body 5 along the catching recess sections 10, the engaging sections 12 of the decorative member 6 are pulled out from end sides of the catching recess sections 10, whereby the decorative member 6 is removed. By this procedure being repeated, the plurality of decorative members 6 can be switched to other decorative members as necessary.

As described above, at least one of the watch bands 2 of the wristwatch includes the band main body 5 having the catching recess sections 10 each of which is a catching portion whose one end is open and formed along the longitudinal direction, and the decorative members 6 each of which has the decorative main body 11 that is arranged on the outer surface of the band main body 5 and the engaging sections 12 that are provided on the decorative main body 11 and slidably caught in the catching recess sections 10. As a result of this structure, the decorativeness can be enhanced by the decorative members 6 which can be easily and favorably attached.

That is, in the case of this watch band 2, the engaging sections 12 of each decorative member 6 can be inserted into and caught in the catching recess sections 10 through one open end of each catching recess section 10 of the band main body 5, whereby the decorative members 6 can be easily attached to the band main body 5. Also, the decorative main body 11 of each decorative member 6 is arranged on the outer surface of the band main body 5, and the engaging sections 12 of each decorative member 6 are arranged and caught in the catching recess sections 10 of the band main body 5, whereby the engaging sections 12 do not protrude from the inner surface of the band main body 5. Accordingly, when the wristwatch case 1 is being used by being worn on an arm, the engaging sections 12 of the decorative members 6 do not bite into the arm. As a result of this structure, a sense of discomfort is not felt when the wristwatch case 1 is worn on an arm, and the decorative members 6 can be favorably attached to the band main body 5 with a good wearing feeling.

Also, in the case of this watch band 2, since the catching recess sections 10 are formed in the sides of the inner surface of the band main body 5 and the engaging sections 12 formed on the ends of the decorative main body 11 are arranged in these catching recess sections 10 and thereby do not protrude from the inner surface of the band main body 5, the entire watch band 2 can be thinly formed, and the contact area of each decorative member 6 with respect to an arm can be reduced. In the case where the decorative members 6 are made of metal, this structure serves as measures for metal allergy.

Moreover, in the case of this watch band 2, each decorative member 6 has the simple structure including only the decorative main body 11 which is arranged on the outer surface of the band main body 5 and the engaging sections 12 which are formed on the decorative main body 11 and caught in the catching recess sections 10. Since the structure of each decorative member 6 is simple, each decorative member 6 can be manufactured as one part, whereby the number of components of each decorative member 6 can be reduced, and the parts management and manufacture of the decorative members 6 can be easily performed.

Furthermore, in the case of this watch band 2, on one end of each catching recess section 10 of the band main body 5 in the longitudinal direction, or more specifically, on the ends of the catching recess sections 10 located on the side opposite to the end portion 5*a* of the band main body 5, the stopper sections 10*a* with which the engaging sections 12 of the corresponding decorative member 6 come in contact are formed. By this structure where the engaging sections 12 of the decorative member 6 come in contact with the stopper sections 10*a* of the catching recess sections 10, the decorative member 6 can be arranged at a predetermined position on the band main body 5. Accordingly, although the catching recess sections 10 are formed such that their portions on the side opposite to the end portion 5*a* side of the band main body 5 are narrow, the decorative member 6 is prevented from slipping out from the other end side of the band main body 5.

Still further, in the case of this watch band 2, the catching recess sections 10 are formed in the sides of the inner surface of the band main body 5 in the transverse direction perpendicular to the longitudinal direction, and the engaging sections 12 are formed to the sides of the decorative main body 11. Accordingly, the engaging sections 12 formed to the sides of the decorative main body 11 are caught in the catching recess sections 10 formed in the sides of the inner surface of the band main body 5 in the transverse direction. As a result of this structure, each decorative member 6 can be reliably and favorably attached to the band main body 5 in a stable state.

Yet still further, in the case of this watch band 2, the sides of the band main body 5 in the transverse directions perpendicular to the longitudinal direction project further in the transverse directions than the sides of the connection section 7 provided on the end portion 5*a* of the band main body 5 in the longitudinal direction. Accordingly, although the connection section 7 is provided on the end portion 5*a* of the band main body 5, the engaging sections 12 of each decorative member 6 can be caught in the catching recess section 10 in the sides of the band main body 5 without being blocked by the connection section 7. As a result of this structure, the decorative members 6 can be favorably attached to or detached from the band main body 5 so as to be switched to other decorative members.

Yet still further, in the case of this watch band 2, the decorative main body 11 is arranged on the outer surface of the band main body 5 in a manner to extend in the transverse direction perpendicular to the longitudinal direction, and the engaging sections 12 are caught in the catching recess sections 10 and slidably pinch the sides of the band main body 5 in a manner not to protrude from the inner surface of the band main body 5. Accordingly, the engaging sections 12 formed to the sides of the decorative main body 11 can be caught in the catching recess sections 10 with the decorative main body 11 being arranged on the outer surface of the band main body 5, and favorably and slidably pinch the sides of the band main body 5.

As a result, in the case of this watch band 2, each decorative member 6 can be further reliably and favorably attached to the band main body 5, and the engaging sections 12 do not protrude from the inner surface of the band main body 5 when they are arranged in the catching recess sections 10. As a result of this structure, a sense of discomfort is not felt when the wristwatch case 1 is worn on an arm, and the decorative members 6 can be favorably attached to the band main body 5 with a good wearing feeling.

Second Embodiment

Next, a second embodiment where the present invention has been applied in a wristwatch will hereinafter be described with reference to FIG. 6 to FIG. 9B. Note that sections that are the same as those of the first embodiment shown in FIG. 1 to FIG. 5 are provided with the same reference numerals in the descriptions below.

Figure 6:
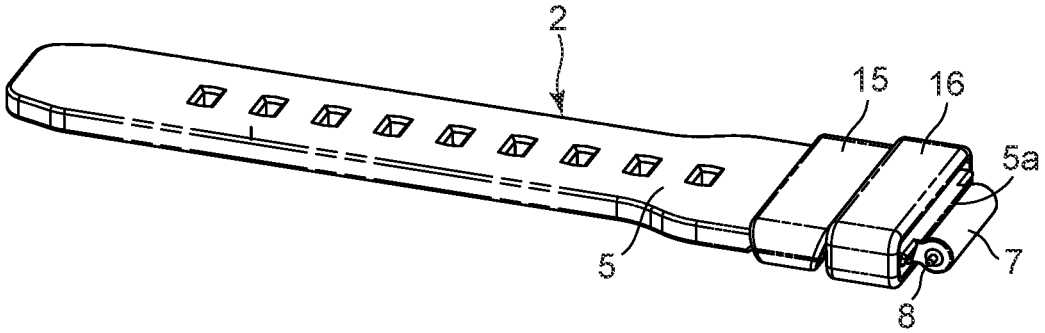
FIG. 6 is an enlarged perspective view showing the outer surface side of a watch band in a second embodiment where the present invention has been applied in a wristwatch.
Figure 7:
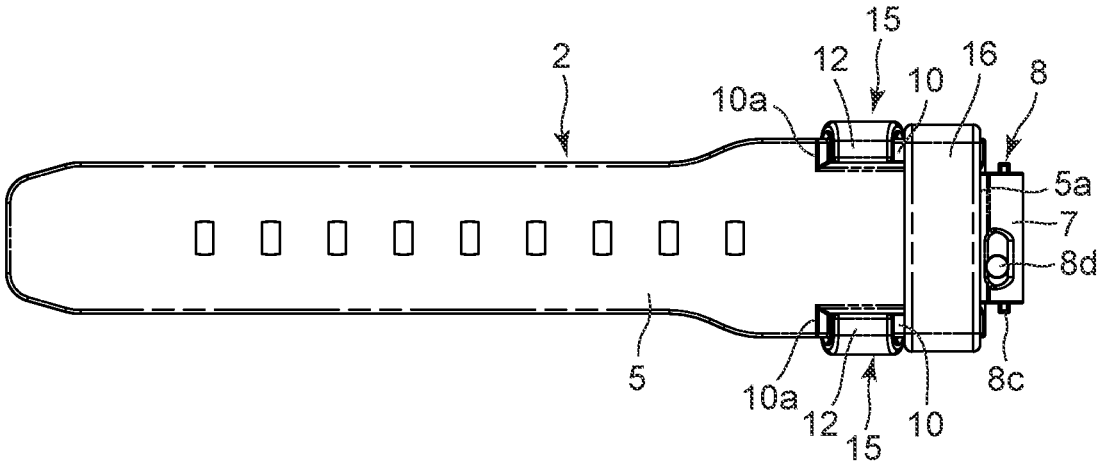
FIG. 7 is an enlarged rear view of the watch band shown in FIG. 6.

The structure of this wristwatch is the same as that of the first embodiment except that a first decorative member 15 and a second decorative member 16 are attached to the band main body 5 such that they can be switched to other decorative members, as shown in FIG. 6 and FIG. 7.

Figure 8:
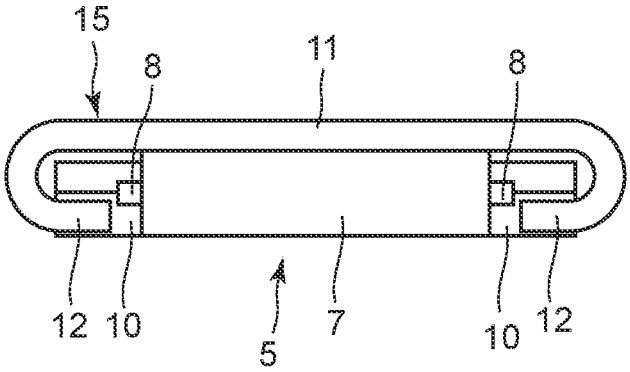
FIG. 8 is an enlarged side view showing a main portion of the watch band to which a first decorative member shown in FIG. 6 has been attached.

The first decorative member 15 has exactly the same structure as that of each decorative member 6 of the first embodiment, as shown in FIG. 6 to FIG. 8. Also, the second decorative member 16 is made of a metal such as stainless steel, titanium, and aluminum, or a hard synthetic resin such as ABS (Acrylonitrile Butadiene Styrene) resin, as in the case of each decorative member 6 of the first embodiment. This second decorative member 16 includes a decorative main body 17 provided with an insertion hole 17*a* into which the band main body 5 is inserted, and engaging sections 18 which are provided to the sides of the insertion hole 17*a* of the decorative main body 17 and caught in the catching recess sections 10 of the band main body 5, as shown in FIG. 6, FIG. 7, FIG. 9A, and FIG. 9B.

The decorative main body 17 of the second decorative member 16 is formed by a band plate elongated in the transverse direction of the band main body 5 being bent in a substantially rectangular ring shape, as shown in FIG. 6, FIG. 7, and FIG. 9. The thickness of this decorative main body 17 is sufficiently greater than that of the band main body 5. Also, in this decorative main body 17, a partition 17*b* is provided in which the insertion hole 17*a* is formed. Note that the insertion hole 17*a* is not necessarily required to be formed in the partition 17*b*, and is only required to be formed in the decorative main body 17. In the case where the insertion hole 17*a* is formed in the decorative main body 17, the partition 17*b* is only required to form the engaging sections 18 which are located to the sides of the insertion hole 17*a* of the decorative main body 17.

Figure 9A:
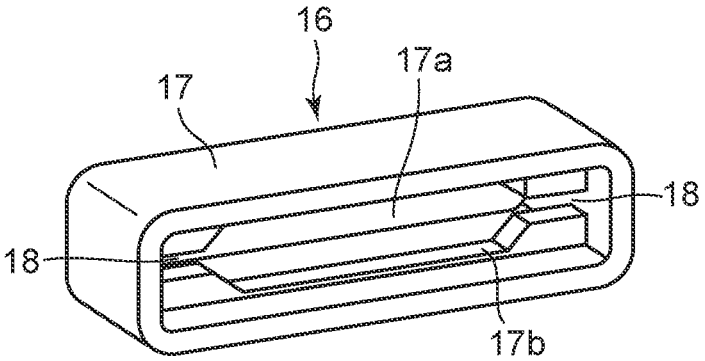
FIG. 9A is an enlarged perspective view of a second decorative member shown in FIG. 6.
Figure 9B:
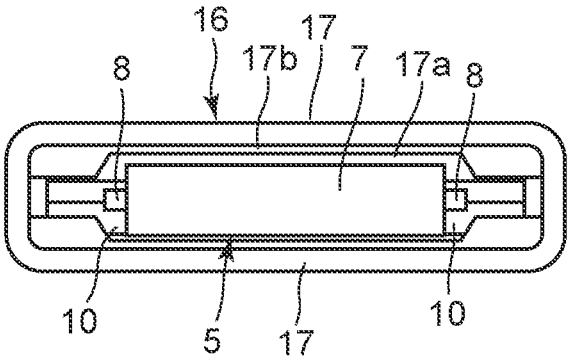
FIG. 9B is an enlarged side view showing a main portion of the watch band to which the second decorative member shown in FIG. 6 has been attached.

This insertion hole 17*a* of the decorative main body 17 is a hole into which the band main body 5 is inserted such that the connection section 7 on its end portion 5*a* is inserted first, as shown in FIG. 9A and FIG. 9B. Also, the engaging sections 18 are portions including holes into which the sides of the band main body 5 in the transverse direction are slidably inserted, and structured to be caught in the catching recess sections 10 and slidably hold the sides of the band main body 5.

The second decorative member 16 is structured such that, when the connection section 7 provided on the end portion 5*a* of the band main body 5 is inserted into the insertion hole 17*a* of the decorative main body 17, the decorative main body 17 is arranged on both of the inner and outer sides of the band main body 5, as shown in FIG. 9A and FIG. 9B. Also, this second decorative member 16 is structured such that, when the connection section 7 is inserted into and passes through the insertion hole 17*a* of the decorative main body 17, the engaging sections 18 provided to the sides of the insertion hole 17*a* are slidably caught in the catching recess sections 10 in the sides of the band main body 5.

Moreover, this second decorative member 16 is structured such that, when the engaging sections 18 are caught in the catching recess sections 10 in the sides of the band main body 5, the sides of the band main body 5 in the transverse direction are slidably held by the engaging sections 18 by being inserted into the engaging sections 18, as shown in FIG. 9A and FIG. 9B. Note that this second decorative member 16 may be colored, patterned, or carved, as in the case of each decorative member 6 in the first embodiment.

In this embodiment as well, on one end of each catching recess section 10 of the band main body 5 in the longitudinal direction, or more specifically, on the ends of the catching recess sections 10 located on the side opposite to the end portion 5*a* of the band main body 5, the stopper sections 10*a* with which the engaging sections 12 of the first decorative member 15 or the engaging sections 18 of the second decorative member 16 come in contact are formed, as shown in FIG. 7. As a result, the first decorative member 15 and the second decorative member 16 are structured such that, when the engaging sections 12 of the first decorative member 15 or the engaging sections 18 of the second decorative member 16 come in contact with the stopper sections 10*a*, these sections which are in contact with the stopper sections 10*a* are arranged at predetermined positions on the band main body 5.

Next, a procedure for switching the first decorative member 15 and the second decorative member 16 attached to the corresponding watch band 2 of the wristwatch to other decorative members is described.

First, the watch band 2 is detached from the corresponding band attachment section 3 of the wristwatch case 1, as in the case of the first embodiment.

Here, the lever section 8*d* of the connection member 8 inserted into the attachment hole 7*a* in the connection section 7 of the band main body 5 is operated so as to release the connection between the band main body 5 and the band attachment section 3 of the wristwatch case 1 by the connection member 8, as with the first embodiment. As a result, the connection between the band main body 5 and the band attachment section 3 of the wristwatch case 1 by the connection member 8 is released, whereby the watch band 2 is detached from the band attachment section 3 of wristwatch case 1.

In this state, one of the first and second decorative members 15 and 16 is slid to be detached from the watch band 2. In a case where the second decorative member 16 is detached, when the second decorative member 16 is slid in the longitudinal direction of the watch band 2, the engaging sections 18 of the second decorative member 16 are slid along the catching recess sections 10 in the sides of the band main body 5 in the transverse direction with them being caught in the catching recess section 10.

That is, the catching recess sections 10 formed in the sides of the band main body 5 in the transverse direction are located further outside in the transverse direction of the band main body 5 than the sides of the connection section 7 provided on the end portion 5*a* of the band main body 5. Accordingly, when slid toward the connection section 7 side of the band main body 5 along the catching recess sections 10, the engaging sections 18 of the second decorative member 16 are pulled out from the catching recess sections 10, and the connection section 7 of the band main body 5 passes through and is pulled out from the insertion hole 17*a* of the decorative main body 17. As a result, the second decorative member 16 can be switched to another decorative member.

Also, in a case where the first decorative member 15 is detached, the first decorative member 15 is slid in the longitudinal direction of the watch band 2, whereby the engaging sections 12 of the first decorative member 15 are slid along the catching recess sections 10 in the sides of the band main body 5 in the transverse direction with them being caught in the catching recess sections 10, as in the case of the first embodiment.

In the present embodiment as well, since the catching recess sections 10 formed in the sides of the band main body 5 in the transverse direction are located further outside in the transverse direction of the band main body 5 than the sides of the connection section 7 provided on the end portion 5*a* of the band main body 5, the engaging sections 12 of the first decorative member 15 are pulled out from the catching recess sections 10 when these engaging sections 12 are slid toward the connection section 7 side of the band main body 5 along the catching recess sections 10. As a result, the first decorative member 15 can be detached.

As described above, according to the watch band 2 of the second embodiment, the first decorative member 15 has the same structure as that of the first embodiment, and therefore the same functions and effects as those of the first embodiment are achieved. In addition, the second decorative member 16 includes the decorative main body 17 which is arranged on the inner and outer surfaces of the band main body 5 and extends in the transverse direction of the band main body 5, and the engaging sections 18 which are provided in the sides of the decorative main body 17 and caught in the catching recess sections 10 of the band main body 5. As a result of this structure, the decorativeness can be enhanced, and the second decorative member 16 can be easily, unfailingly, and favorably attached to the band main body 5 in a stable state.

That is, according to the watch band 2 of the second embodiment, the decorative main body 17 of the second decorative member 16 includes the insertion hole 17*a* into which the band main body 5 is inserted such that the connection section 7 on its end portion 5*a* is inserted first, and the engaging sections 18 formed to the sides of the insertion hole 17*a* are caught in the catching recess sections 10 and slidably hold the sides of the band main body 5. As a result of this structure, the second decorative member 16 can be easily attached. Also, when the wristwatch case 1 is worn on an arm, this second decorative member 16 can be favorably attached to the band main body 5 with a good wearing feeling, and a sense of discomfort is not felt. In addition, this second decorative member 16 can be reliably and favorably attached to the band main body 5 in a stable state.

In the case of the watch band 2 of the second embodiment as well, since the second decorative member 16 has the simple structure including only the decorative main body 17 which is arranged on the inner and outer surfaces of the band main body 5 and the engaging sections 18 which are formed in the decorative main body 17 and caught in the catching recess sections 10, this second decorative member 16 can be manufactured as one part, whereby the number of components of the second decorative member 16 can be reduced, and the parts management and manufacture of the second decorative member 16 can be easily performed.

Third Embodiment

Next, a third embodiment where the present invention has been applied in a wristwatch will hereinafter be described with reference to FIG. 10A to FIG. 12. Note that sections that are the same as those of the first embodiment shown in FIG. 1 to FIG. 5 and the second embodiment shown in FIG. 6 to FIG. 9B are provided with the same reference numerals in the descriptions below.

Figure 10A:
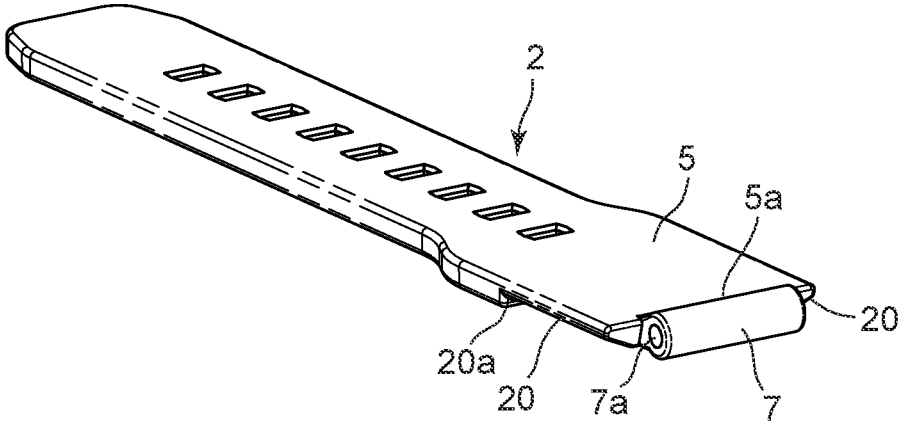
FIG. 10A is an enlarged perspective view showing the outer surface side of a watch band in a third embodiment where the present invention has been applied in a wristwatch.
Figure 10B:
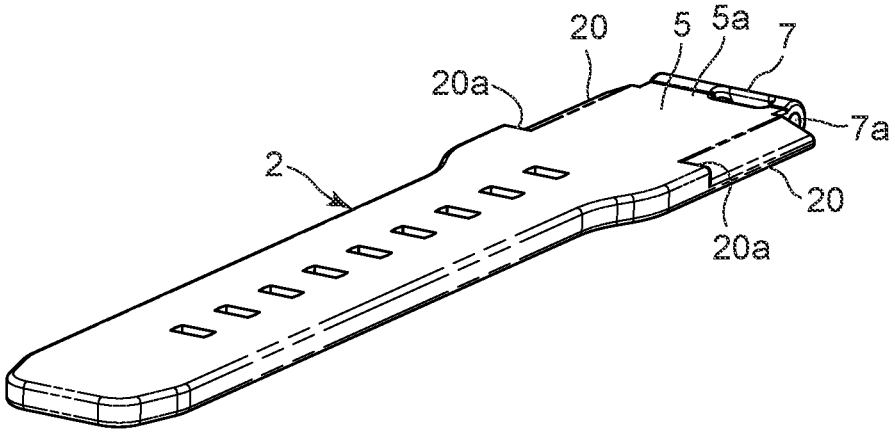
FIG. 10B is an enlarged perspective view showing the inner surface side of the watch band in the third embodiment where the present invention has been applied in a wristwatch.

The structure of this wristwatch is substantially the same as those of the first and second embodiments except that catching recess sections 20 which are catching portions provided in the sides of the band main body 5 in the transverse direction have shapes different from those of the catching recess sections 10 of the first embodiment, as shown in FIG. 10A and FIG. 10B.

Figure 11:
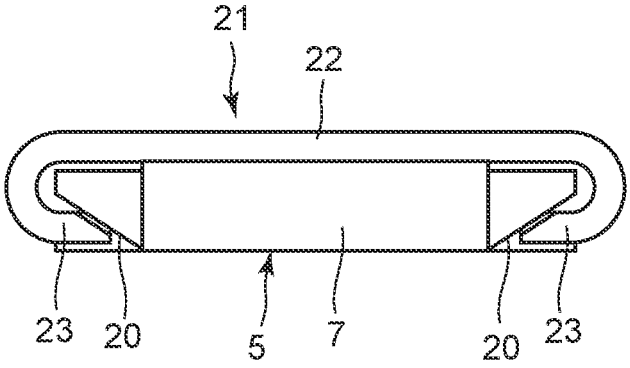
FIG. 11 is an enlarged side view showing a main portion of the watch band of FIG. 10A and FIG. 10B to which a first decorative member has been attached.

More specifically, the catching recess sections 20 of the band main body 5 are formed to be inclined from the inner surface side of the band main body 5 toward the outer surface side of the band main body 5 such that the cross-sectional shape of each catching recess section 20 in the transverse direction of the band main body 5 is a substantially triangular shape, as shown in FIG. 10A and FIG. 10B. Accordingly, a first decorative member 21 in the present embodiment is formed such that engaging sections 23 formed to the sides of its decorative main body 22 so as to be caught in the catching recess section 20 have inclined portions having inclined surfaces whose inclination angles are the same as those of the catching recess sections 20, as shown in FIG. 11. As a result, the first decorative member 21 is structured such that the engaging sections 23 caught in the catching recess sections 20 do not protrude from the inner surface of the band main body 5.

Figure 12:
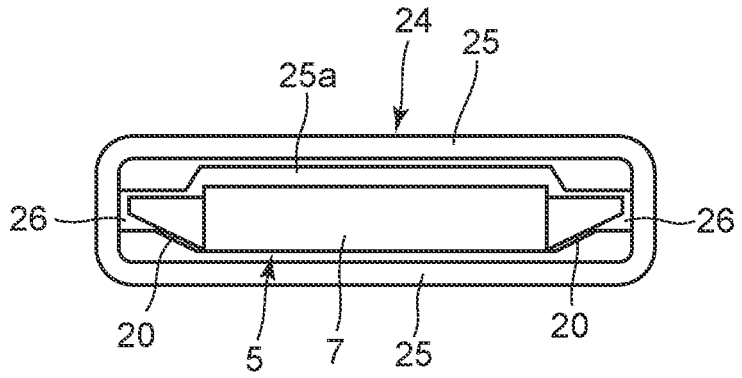
FIG. 12 is an enlarged side view showing a main portion of the watch band of FIG. 10A and FIG. 10B to which a second decorative member has been attached.

Also, a second decorative member 24 in the present embodiment is formed such that engaging sections 26 provided to the sides of an insertion hole 25*a* formed in a decorative main body 25 are portions having holes and inclined surfaces whose inclination angles are the same as those of the catching recess sections 20, as shown in FIG. 12. As a result, the second decorative member 24 is structured such that, when the catching recess sections 20 formed in the sides of the band main body 5 are inserted into the engaging sections 26 of the second decorative member 24 and the engaging sections 26 are caught in the catching recess sections 20 of the band main body 5, the sides of the band main body 5 are slidably held.

In the present embodiment, the first decorative member 21 and the second decorative member 24 may be colored, patterned, or carved, as in the case of the second embodiment. Also, on one end of each catching recess section 20 of the band main body 5 in the longitudinal direction, or more specifically, on the ends of the catching recess sections 10 located on the side opposite to the end portion 5*a* provided with the connection section 7, stopper sections 20*a* with which the engaging sections 23 of the first decorative member 21 or the engaging sections 26 of the second decorative member 24 come in contact are formed.

According to the watch band 2 of the third embodiment, the catching recess sections 20 in the sides of the band main body 5 in the transverse direction are formed to be inclined from the inner surface side of the band main body 5 toward the outer surface side of the band main body 5 such that the cross-sectional shape of each catching recess section 20 in the transverse direction of the band main body 5 is a substantially triangular shape and, accordingly, the engaging sections 23 of the first decorative member 21 and the engaging sections 26 of the second decorative member 24 have the inclined surfaces whose inclination angles are the same as those of the catching recess sections 20. As a result of this structure, the same functions and effects as those of the first and second embodiments are achieved.

That is, according to the watch band 2 of the third embodiment, although the catching recess sections 20 of the band main body 5 are formed to be inclined from the inner surface side of the band main body 5 toward the outer surface side of the band main body 5 such that the cross-sectional shape of each catching recess section 20 in the transverse direction of the band main body 5 is a substantially triangular shape, the engaging sections 23 of the first decorative member 21 caught in the catching recess section 20 do not protrude from the inner surface of the band main body 5 and bite into an arm of the user since these engaging sections 23 of the first decorative member 21 are inclined portions having inclined surfaces whose inclination angles are same as those of the catching recess sections 20. Accordingly, a sense of discomfort is not felt when the wristwatch case 1 is worn on an arm, and the first decorative member 21 can be favorably attached to the band main body 5 with a good wearing feeling.

Also, according to the watch band 2 of the third embodiment, the engaging sections 26, which are portions having holes and inclined surfaces whose inclination angles are the same as those of the catching recess sections 20, are provided to the sides of the insertion hole 25*a* formed in the decorative main body 25 of the second decorative member 24, and favorably caught in the catching recess sections 20 of the band main body 5 so as to slidably hold the sides of the band main body 5. As a result of this structure, the second decorative member 6 can be further reliably and favorably attached to the band main body 5 in a stable state.

Fourth Embodiment

Next, a fourth embodiment where the present invention has been applied in a wristwatch will hereinafter be described with reference to FIG. 13 to FIG. 15. Note that sections that are the same as those of the first embodiment shown in FIG. 1 to FIG. 5 and the second embodiment shown in FIG. 6 to FIG. 9B are provided with the same reference numerals in the descriptions below.

The structure of the watch band 2 of this wristwatch is substantially the same as those of the first and second embodiments except that, in a middle portion of the band main body 5 in the transverse direction, a cutout groove 30 which is a catching portion is formed extending in the longitudinal direction of the band main body 5.

Figure 13:
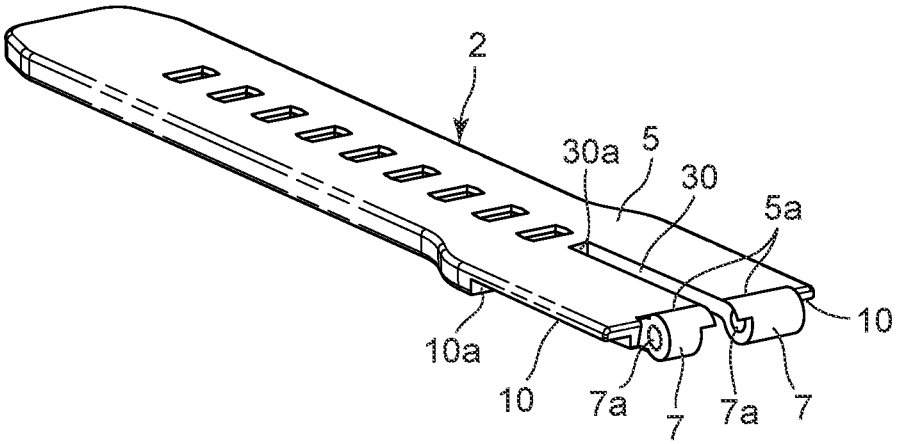
FIG. 13 is an enlarged perspective view showing the outer surface side of a watch band in a fourth embodiment where the present invention has been applied in a wristwatch.

In this embodiment as well, in the sides of the band main body 5 in the transverse direction, the same catching recess sections 10 as those of the first embodiment are formed, as shown in FIG. 13. Also, as in the case of the first embodiment, a first decorative member 31 in the present embodiment, which is attached to the band main body 5, has a structure where first engaging sections 31*b* are formed to the sides of a decorative main body 31*a*, as shown in FIG. 14.

Figure 15:
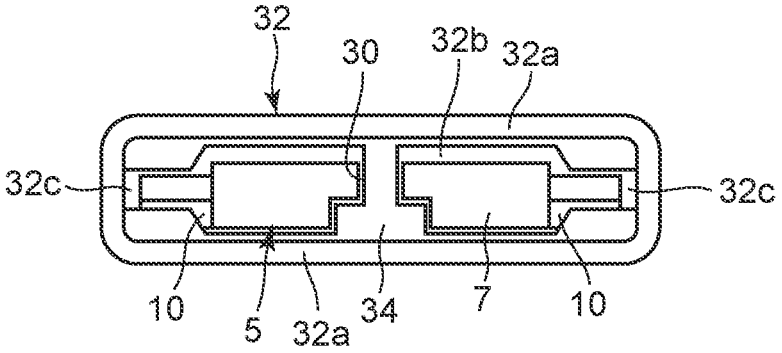
FIG. 15 is an enlarged side view showing a main portion of the watch band of FIG. 13 to which a second decorative member has been attached.

Similarly, a second decorative member 32 in the present embodiment has a structure where first engaging sections 32*c* are formed to the sides of an insertion hole 32*b* in a decorative main body 32*a* as in the case of the second embodiment, as shown in FIG. 15. Note that the first decorative member 21 and the second decorative member 24 may be colored, patterned, or carved, as in the case of the second embodiment.

Figure 14:
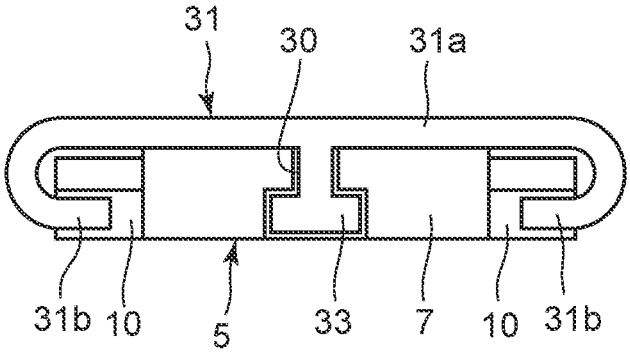
FIG. 14 is an enlarged side view showing a main portion of the watch band of FIG. 13 to which a first decorative member has been attached.

The cutout groove 30 formed in the middle portion of the band main body 5 extends in the longitudinal direction of the band main body 5 from the connection section 7 on the end portion 5*a* of the band main body 5 in a manner to have the same length as each catching recess section 10, as shown in FIG. 13 to FIG. 15. This cutout groove 30 is a groove penetrating through the inner and outer surfaces of the band main body 5, and its cross-sectional shape is an inverted T shape. That is, this cutout groove 30 is formed such that its groove width, which is its length in the transverse direction of the band main body 5, is larger on the inner side of the band main body 5 than on the outer side of the band main body 5. Note that a structure may be adopted in which the cutout groove 30 is closed on the inner side of the band main body 5 so as not to penetrate through the inner and outer surfaces of the band main body 5, and its cross-sectional shape is an inverted T shape.

Also, the cutout groove 30 is structured to slidably catch a second engaging section 33 of the first decorative member 31 and a second engaging section 34 of the second decorative member 32, as shown in FIG. 13 to FIG. 15. In this embodiment, on an end of the cutout groove 30 in the longitudinal direction, or more specifically, on the end of the cutout groove 30 located on the side opposite to the end portion 5*a* of the band main body 5 provided with the connection section 7, a stopper section 30*a* with which the second engaging section 33 of the first decorative member 31 or the second engaging section 34 of the second decorative member 32 come in contact is formed.

Of the first and second decorative members 31 and 32, the second engaging section 33 of the first decorative member 31 is provided on the undersurface of a middle portion of the decorative main body 31*a*, as shown in FIG. 14. This second engaging section 33 has a shape that is the same as the cross-sectional shape of the cutout groove 30, that is, an inverted T shape, and is structured to be caught in the cutout groove 30 of the band main body 5.

As a result, the first decorative member 31 is structured such that the first engaging sections 31*b* formed to the sides of the decorative main body 31*a* are slidably caught in the catching recess sections 10 in the sides of the band main body 5 with the connection member 8 being detached from the connection section 7 of the band main body 5, and the second engaging section 33 provided on the middle portion of the decorative main body 31*a* is inserted into and slidably caught in the cutout groove 30 in the middle portion of the band main body 5 in the longitudinal direction, as shown in FIG. 14.

Also, the second engaging section 34 of the second decorative member 32 is provided extending from a middle portion of the upper surface of the decorative main body 32*a* to a middle portion of the bottom surface thereof, as shown in FIG. 15. This second engaging section 34 has a shape that is the same as the cross-sectional shape of the cutout groove 30, that is, an inverted T shape, and is structured to be caught in the cutout groove 30 of the band main body 5, as with the second engaging section 33 of the first decorative member 31.

As a result, the second decorative member 32 is structured such that the first engaging sections 32*c* formed in the sides of the decorative main body 32*a* are slidably caught in the catching recess sections 10 in the sides of the band main body 5 with the connection member 8 being detached from the connection section 7 of the band main body 5, and the second engaging section 34 provided in the middle portion of the decorative main body 32*a* is inserted into and slidably caught in the cutout groove 30 in the middle portion of the band main body 5 in the longitudinal direction, as in the case of the first decorative member 31.

According to the watch band 2 of the fourth embodiment, the first engaging sections 31*b* formed to the sides of the decorative main body 31*a* of the first decorative member 31 is slidably caught in the catching recess sections 10 formed in the sides of the band main body 5, and the second engaging section 33 provided on the middle portion of the decorative main body 31*a* is slidably caught in the cutout groove 30 formed in the middle portion of the band main body 5. As a result of this structure, the decorativeness can be enhanced, as in the case of the first embodiment. In addition, the first decorative member 31 can be easily attached, and the second engaging section 33 does not protrude from the inner surface of the band main body 5. Accordingly, the wristwatch case 1 can be favorably worn on an arm with a good wearing feeling, and the first decorative member 31 can be unfailingly and favorably attached to the band main body 5 in a stable state.

Similarly, according to the watch band 2 of the fourth embodiment, the first engaging sections 32*c* formed in the sides of the decorative main body 32*a* of the second decorative member 32 slidably engage with the catching recess sections 10 formed in the sides of the band main body 5, and the second engaging section 34 provided in the middle portion of the decorative main body 32*a* is slidably caught in the cutout groove 30 formed in the middle portion of the band main body 5. As a result of this structure, the decorativeness can be enhanced. In addition, the second decorative member 32 can be easily attached, and the second engaging section 34 does not protrude from the inner surface of the band main body 5. Accordingly, the wristwatch case 1 can be favorably worn on an arm with a good wearing feeling, and the second decorative member 32 can be unfailingly and favorably attached to the band main body 5 in a stable state, as in the case of the first decorative member 31.

Figure 16:
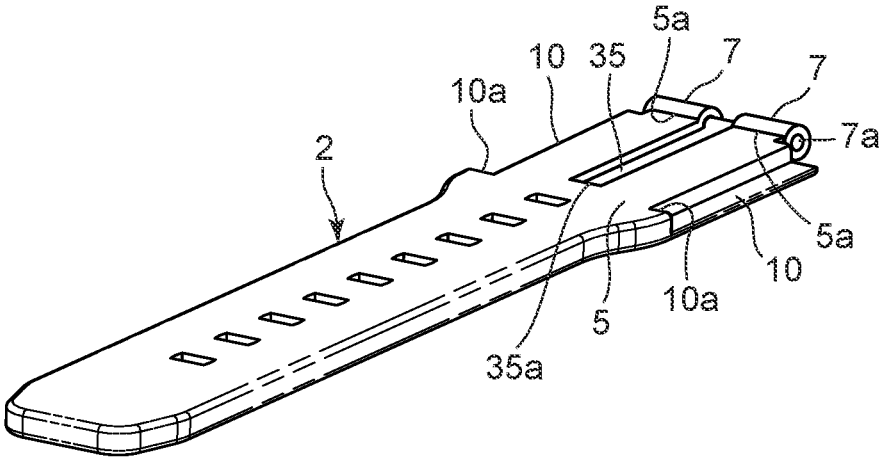
FIG. 16 is an enlarged perspective view showing the inner surface side of a watch band in a modification example of the fourth embodiment shown in FIG. 13.

In the above-described fourth embodiment, the cutout groove 30 of the band main body 5 is formed penetrating through the inner and outer surfaces of the band main body 5. However, the present invention is not limited thereto. For example, a structure may be adopted in which a recessed groove 35 is formed in the inner surface of the band main body 5, as in a modification example shown in FIG. 16 and FIG. 17. This recessed groove 35 of the modification example is a groove not penetrating through the inner and outer surfaces of the band main body 5. On an end of this recessed groove 35 as well, a stopper section 35*a* with which a second engaging section 37*c* of a second decorative member 36 comes in contact is formed.

Figure 17:
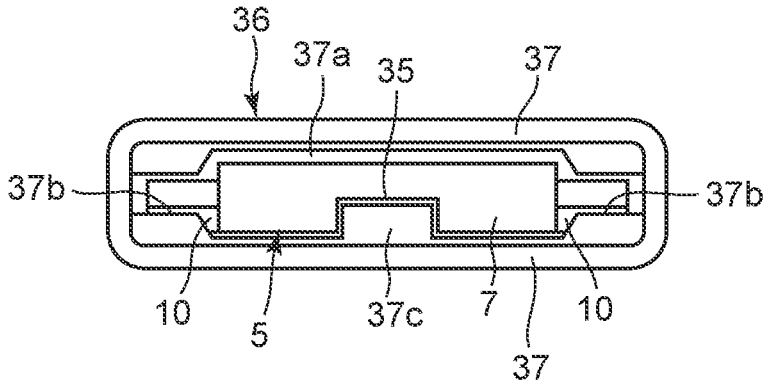
FIG. 17 is an enlarged side view showing a main portion of the watch band of FIG. 16 to which a second decorative member has been attached.

In this modification example as well, the second decorative member 36 has a structure where first engaging sections 37*b* are formed to the sides of an insertion hole 37*a* of a decorative main body 37, and the second engaging section 37*c* which engages with the recessed groove 35 of the band main body 5 is provided in a middle portion of the decorative main body 37, or more specifically, on a middle portion of the upper surface of the lower part of the insertion hole 37*a*, as shown in FIG. 17. By this modification example of the watch band 2, functions and effects that are the same as those of the fourth embodiment can be achieved.

In this modification example of the above-described fourth embodiment, the recessed groove 35 is formed in the inner surface of the band main body 5 while extending in the longitudinal direction of the band main body 5 from the connection section 7 on the end portion 5*a* of the band main body 5. However, the present invention is not limited thereto. For example, a structure may be adopted in which a quadrangular recess is formed in a portion of the inner surface of the band main body 5 on the end portion 5*a* side of the band main body 5.

Also, in the above-described fourth embodiment, the catching recess sections 10 are formed in the sides of the band main body 5 in the transverse direction. However, in the present invention, these catching recess sections 10 in the sides of the band main body 5 in the transverse direction are not necessarily required to be formed, and a structure may be adopted in which only the cutout groove 30 or the recessed groove 35 in the middle portion of the band main body 5 is formed. In this structure, the first decorative member 31 is not required to have the first engaging sections 31*b*, and the second decorative member 32 is not required to have the first engaging sections 32*c*. In addition, the second decorative member 36 in the above-described modification example is not required to have the first engaging sections 37*b*.

Fifth Embodiment

Next, a fifth embodiment where the present invention has been applied in a wristwatch will hereinafter be described with reference to FIG. 18 to FIG. 20. Note that, in the below descriptions as well, sections that are the same as those of the first embodiment shown in FIG. 1 to FIG. 5 and the second embodiment shown in FIG. 6 to FIG. 9B are provided with the same reference numerals.

Figure 18:
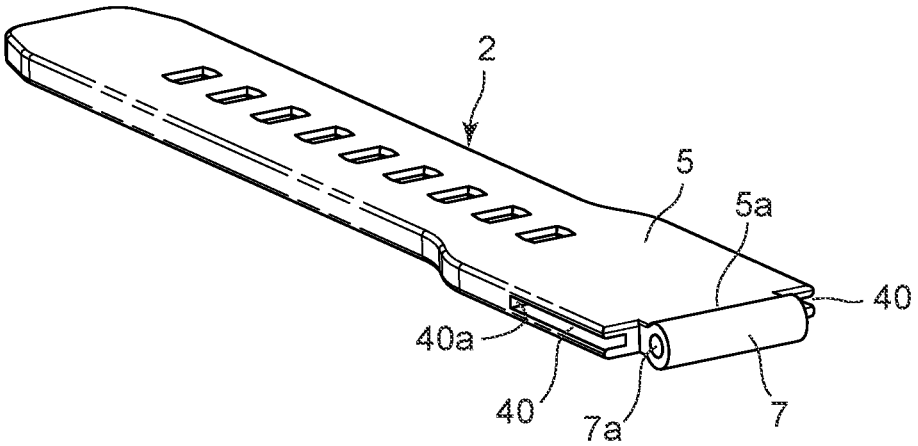
FIG. 18 is an enlarged perspective view showing the outer surface side of a watch band in a fifth embodiment where the present invention has been applied in a wristwatch.

The structure of the watch band 2 of this wristwatch is substantially the same as those of the first and second embodiments except that, in the side surfaces of the band main body 5 in the transverse direction, catching grooves 40 which are catching portions are formed extending in the longitudinal direction of the band main body 5, as shown in FIG. 18.

Figure 19:
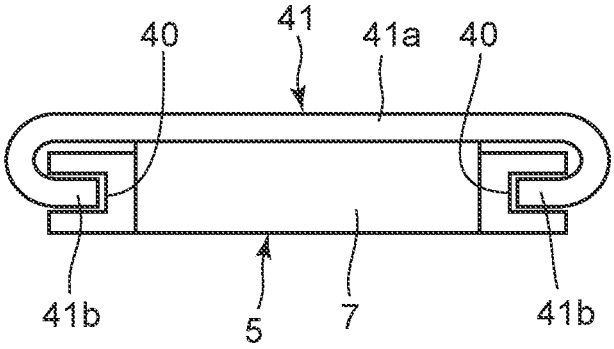
FIG. 19 is an enlarged side view showing a main portion of the watch band of FIG. 18 to which a first decorative member has been attached.
Figure 20:
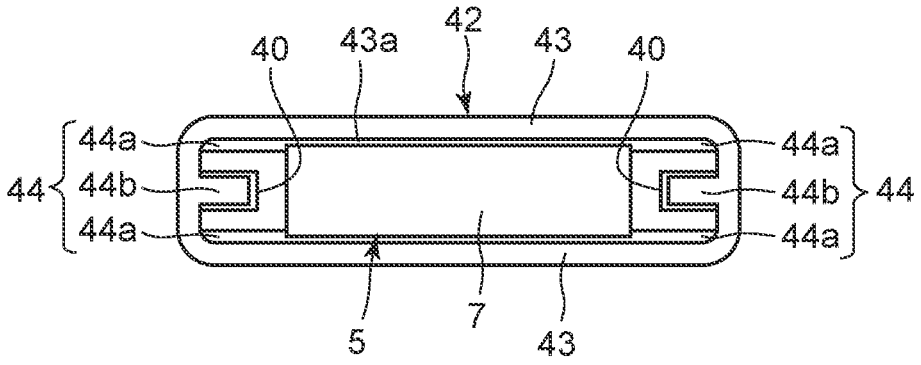
FIG. 20 is an enlarged side view showing a main portion of the watch band of FIG. 18 to which a second decorative member has been attached.

More specifically, each catching groove 40 is formed such that its length in the longitudinal direction of the band main body 5 is substantially equal to the length of each catching recess section 10 in the first embodiment, as shown in FIG. 18 to FIG. 20. The length (depth) of each catching groove 40 in the transverse direction of the band main body 5 is substantially equal to or slightly shorter than the projecting length of each side of the band main body 5 from the sides of the connection section 7 provided on the end portion 5*a* of the band main body 5.

Also, each catching groove 40 is formed such that its length in a thickness direction of the band main body 5 (or more specifically, a direction from the outer surface of the band main body 5 toward the inner surface thereof) is about one-half to one-third of the length of the band main body 5 in the thickness direction, as shown in FIG. 18 to FIG. 20. In this embodiment as well, on an end of each catching groove 40 in the longitudinal direction, or more specifically, on the ends of the catching grooves 40 located on the side opposite to the end portion 5*a* of the band main body 5, stopper sections 40*a* with which engaging sections 41*b* of a first decorative member 41 in the present embodiment or engaging sections 44 of a second decorative member 42 in the present embodiment come in contact are formed.

The first decorative member 41 and the second decorative member 42 are attached to the band main body 5, as shown in FIG. 19 and FIG. 20. These first and second decorative members 41 and 42 may be colored, patterned, or carved, as in the case of the second embodiment.

The first decorative member 41 includes a decorative main body 41*a* which is arranged on the outer surface of the band main body 5 and engaging sections 41*b* which are provided to the sides of the decorative main body 41*a* and inserted into and caught in the catching grooves 40 of the band main body 5, as shown in FIG. 19. As a result, the first decorative member 41 is structured such that, when the decorative main body 41*a* is slid above the connection section 7 of the band main body 5 in the longitudinal direction, the engaging sections 41*b* provided to the sides of the decorative main body 41*a* are inserted into and slidably caught in the catching grooves 40 formed in the sides of the band main body 5.

The second decorative member 42 includes a decorative main body 43 having an insertion hole 43*a* into which the connection section 7 of the band main body 5 is inserted, and engaging sections 44 provided to the sides of the insertion hole 43*a* of the decorative main body 43 and caught in the catching grooves 40 in the sides of the band main body 5, as shown in FIG. 20. The decorative main body 43 is structured to be arranged on the inner and outer surfaces of the band main body 5 when the band main body 5 is inserted into the insertion hole 43*a*. The engaging sections 44 include recess sections 44*a* in which the sides of the band main body 5 are arranged, and projection sections 44*b* which are provided in the recess sections 44*a* and inserted into the catching grooves 40 of the band main body 5.

As a result, the second decorative member 42 is structured such that, when the connection section 7 of the band main body 5 is inserted into the insertion hole 43*a* of the decorative main body 43, the sides of the band main body 5 are inserted into the recess sections 44*a* of the engaging sections 44, and the projection sections 44*b* of the engaging sections 44 are inserted into the catching grooves 40 in the sides of the band main body 5, whereby the engaging sections 44 are inserted into the catching grooves 40 in the longitudinal direction of the catching grooves 40 and slidably caught therein, as shown in FIG. 20.

According to this watch band 2 of the fifth embodiment, the engaging sections 41*b* provided to the sides of the decorative main body 41*a* of the first decorative member 41 are slidably inserted into and caught in the catching grooves 40 provided in the sides of the band main body 5. As a result of this structure, the decorativeness can be enhanced, the first decorative member 41 can be easily attached, and the engaging sections 41*b* do not protrude from the inner surface of the band main body 5, as in the case of the first embodiment. Accordingly, the wristwatch case 1 can be favorably worn on an arm with a good wearing feeling, and the first decorative member 41 can be unfailingly and favorably attached to the band main body 5 in a stable state.

Also, according to this watch band 2 of the fifth embodiment, when the connection section 7 of the band main body 5 is inserted into the insertion hole 43*a* in the decorative main body 43 of the second decorative member 42, the sides of the band main body 5 are inserted into the recess sections 44*a* of the engaging sections 44, and the projection sections 44*b* of the engaging sections 44 are inserted into the catching grooves 40 in the sides of the band main body 5, whereby the engaging sections 44 are slidably caught in the catching grooves 40. As a result of this structure, the decorativeness can be enhanced, the second decorative member 42 can be easily attached, and the engaging sections 44 do not protrude from the inner surface of the band main body 5, as in the case of the second embodiment. Accordingly, the wristwatch case 1 can be favorably worn on an arm with a good wearing feeling, and the second decorative member 42 can be unfailingly and favorably attached to the band main body 5 in a stable state.

In the above-described second to fifth embodiments, the first decorative member 15, 21, 31, or 41 and the second decorative member 16, 24, 32, or 42 are attached to the band main body 5. However, the present invention is not limited thereto, and a structure where only the first decorative member 15, 21, 31, or 41 is attached, or a structure where only the second decorative member 16, 24, 32, or 42 is attached may be adopted.

Also, in the above-described first to fifth embodiments and the modification example, the present invention has been applied in a wristwatch. However, the present invention is not necessarily required to be applied in wristwatches. For example, the present invention is widely applicable to briefcases, handbags, clothes, or the like.

While the present invention has been described with reference to the preferred embodiments, it is intended that the invention be not limited by any of the details of the description therein but includes all the embodiments which fall within the scope of the appended claims.

What is claimed is:

1. A band comprising:

a band main body in which a catching portion with one end open is provided extending in a longitudinal direction; and a decorative member having a decorative main body which is arranged on at least an outer surface of the band main body and an engaging portion which is provided on the decorative main body and slidably caught in the catching portion, wherein a stopper portion with which the engaging portion of the decorative member comes in contact is provided on an other end of the catching portion of the band main body which is located on a side opposite to the one end in the longitudinal direction.

2. The band according to claim 1, wherein the catching portion and the engaging portion are plurally provided, respectively, wherein the catching portions are catching recess portions provided in sides of an inner surface of the band main body in a transverse direction perpendicular to the longitudinal direction, and wherein the engaging portions are provided on sides of the decorative main body.

3. The band according to claim 2, wherein the catching portions of the band main body are respectively located further outside in transverse directions of the band main body than sides of a connection portion provided on an end of the band main body on a side of the one end in the longitudinal direction.

4. The band according to claim 2, wherein the decorative main body is arranged on the outer surface of the band main body in a manner to extend in the transverse direction perpendicular to the longitudinal direction, wherein the engaging portions are caught in the catching portions in a manner to slidably pinch sides of the band main body, and wherein the engaging portions arranged in the catching portions do not protrude from the inner surface of the band main body.

5. The band according to claim 2, wherein the decorative main body is (i) provided with an insertion hole into which the band main body is inserted such that a connection portion provided on an end of the band main body on a side of the one end in the longitudinal direction is inserted first, and (ii) arranged on inner and outer surfaces of the band main body, and wherein the engaging portions are provided to sides of the insertion hole and caught in the catching portions in a manner to pinch sides of the band main body.

6. The band according to claim 1, wherein the catching portion and the engaging portion are plurally provided, respectively, and wherein the catching portions of the band main body are respectively located further outside in transverse directions of the band main body than sides of a connection portion provided on an end of the band main body on a side of the one end in the longitudinal direction.

7. The band according to claim 1, wherein the catching portion and the engaging portion are plurally provided, respectively, wherein the decorative main body is arranged on the outer surface of the band main body in a manner to extend in a transverse direction perpendicular to the longitudinal direction, wherein the engaging portions are caught in the catching portions in a manner to slidably pinch sides of the band main body, and wherein the engaging portions arranged in the catching portions do not protrude from an inner surface of the band main body.

8. The band according to claim 1, wherein the catching portion and the engaging portion are plurally provided, respectively, wherein the decorative main body is (i) provided with an insertion hole into which the band main body is inserted such that a connection portion provided on an end of the band main body on a side of the one end in the longitudinal direction is inserted first, and (ii) arranged on inner and outer surfaces of the band main body, and wherein the engaging portions are provided to sides of the insertion hole and caught in the catching portions in a manner to pinch sides of the band main body.

9. The band according to claim 1, wherein the catching portion is a cutout groove which is provided in a middle portion of the band main body in a transverse direction and extends in the longitudinal direction of the band main body, and wherein the engaging portion is provided on a middle portion of the decorative main body in the transverse direction and slidably caught in the cutout groove.

10. The band according to claim 9, wherein the cutout groove is a groove which penetrates through inner and outer surfaces of the band main body and whose groove width in the transverse direction of the band main body is smaller on a side of the outer surface of the band main body than on the inner surface side.

11. The band according to claim 1, wherein the catching portion and the engaging portion are plurally provided, respectively, wherein the catching portions are catching grooves formed in the longitudinal direction in side surfaces of the band main body, and wherein the engaging portions are provided on sides of the decorative main body in a transverse direction and slidably inserted into the catching grooves.

12. The band according to claim 1, wherein the catching portion is a cutout section in which one end in a longitudinal direction of the band main body and at least one of an inner surface and a side surface of the main body are open, and wherein a side of the one end is more widely open than a side of an other end which is located on the side opposite to the one end.

13. A timepiece comprising:

a band comprising:

a band main body in which a catching portion with one end open is provided extending in a longitudinal direction; and a decorative member having a decorative main body which is arranged on at least an outer surface of the band main body and an engaging portion which is provided on the decorative main body and slidably caught in the catching portion.

14. The timepiece according to claim 13, wherein a stopper portion with which the engaging portion of the decorative member comes in contact is provided on an other end of the catching portion of the band main body which is located on a side opposite to the one end in the longitudinal direction.

15. The timepiece according to claim 13, wherein the catching portion and the engaging portion are plurally provided, respectively, wherein the catching portions are catching recess portions provided in sides of an inner surface of the band main body in a transverse direction perpendicular to the longitudinal direction, and wherein the engaging portions are provided on sides of the decorative main body.

16. The timepiece according to claim 13, wherein the catching portion and the engaging portion are plurally provided, respectively, and wherein the catching portions of the band main body are respectively located further outside in transverse directions of the band main body than sides of a connection portion provided on an end of the band main body on a side of the one end in the longitudinal direction.

17. The timepiece according to claim 13, wherein the catching portion and the engaging portion are plurally provided, respectively, wherein the decorative main body is arranged on the outer surface of the band main body in a manner to extend in a transverse direction perpendicular to the longitudinal direction, wherein the engaging portions are caught in the catching portions in a manner to slidably pinch sides of the band main body, and wherein the engaging portions arranged in the catching portions do not protrude from an inner surface of the band main body.

18. The timepiece according to claim 13, wherein the catching portion and the engaging portion are plurally provided, respectively, wherein the decorative main body is (i) provided with an insertion hole into which the band main body is inserted such that a connection portion provided on an end of the band main body on a side of the one end in the longitudinal direction is inserted first, and (ii) arranged on inner and outer surfaces of the band main body, and wherein the engaging portions are provided to sides of the insertion hole and caught in the catching portions in a manner to pinch sides of the band main body.

19. The timepiece according to claim 13, wherein the catching portion is a cutout groove which is provided in a middle portion of the band main body in a transverse direction and extends in the longitudinal direction of the band main body, and wherein the engaging portion is provided on a middle portion of the decorative main body in the transverse direction and slidably caught in the cutout groove.

20. The timepiece according to claim 13, wherein the catching portion and the engaging portion are plurally provided, respectively, wherein the catching portions are catching grooves formed in the longitudinal direction in side surfaces of the band main body, and wherein the engaging portions are provided on sides of the decorative main body in a transverse direction and slidably inserted into the catching grooves.

* * * * *